US008059844B2

(12) United States Patent
Westerkull et al.

(10) Patent No.: US 8,059,844 B2
(45) Date of Patent: Nov. 15, 2011

(54) BONE CONDUCTING HEARING AID WITH CONNECTION

(75) Inventors: Patrik Westerkull, Hovas (SE); Anton Hedström, Göteborg (SE); Bengt Bern, Mölndal (SE)

(73) Assignee: Oticon A/S, Smorum (DK)

( * ) Notice: Subject to any disclaimer, the term of this patent is extended or adjusted under 35 U.S.C. 154(b) by 499 days.

(21) Appl. No.: 12/324,733

(22) Filed: Nov. 26, 2008

(65) Prior Publication Data

US 2009/0192345 A1 Jul. 30, 2009

(30) Foreign Application Priority Data

Jan. 28, 2008 (EP) ..... 08100995

(51) Int. Cl.
*H04R 25/00* (2006.01)

(52) U.S. Cl. ..... 381/322; 381/151; 381/328; 381/329

(58) Field of Classification Search ..... 381/151, 381/322, 328, 329
See application file for complete search history.

(56) References Cited

U.S. PATENT DOCUMENTS

2005/0228213 A1 10/2005 Schneider et al.
2005/0248158 A1 11/2005 Westerkull
2006/0045298 A1 3/2006 Westerkull

FOREIGN PATENT DOCUMENTS

EP 2 066 140 A1 * 11/2007
WO WO-2007/102894 A 9/2007

* cited by examiner

*Primary Examiner* — Jasmine Clark

(74) *Attorney, Agent, or Firm* — Birch, Stewart, Kolasch & Birch, LLP

(57) ABSTRACT

The hearing aid according to the invention comprise:

a skin penetrating abutment, a skin penetrating abutment, a rod with a coupling part, operative to allow releasable connection between the rod and the abutment, a hearing aid housing with an opening, where the rod extends through the opening and into the hearing aid housing, a vibrator connected to the rod in the hearing aid housing, and resiliently mounted between a distal housing wall part which faces away from the opening and a proximal housing wall part which comprises the opening, whereby the proximal wall part further comprise a relief portion which extends into the area between the vibrator and the coupling part of the rod and where, the distance between the relief portion and the coupling part of the rod is smaller than the distance between the vibrator and the inside of the distal wall part.

9 Claims, 5 Drawing Sheets

BONE CONDUCTING HEARING AID WITH CONNECTION

The invention regards a direct bone conducting hearing aid.

BACKGROUND OF THE INVENTION

In resent years, bone conducting hearing aids which are fastened to a screw implanted in the skull bone, have become successful for certain types of hearing losses. In an apparatus of this kind, a coupling part is provided between an implanted screw in the skull bone and a rod. The rod extends trough a hole in a hearing aid casing and into the hearing aid where the rod may form part of or is coupled to a vibrator, such that vibrations may be transmitted from the vibrator inside the casing through the rod, coupling, screw and into the skull bone to finally reach the inner ear where the vibrations may be perceived as sound. The coupling between rod and implanted screw usually comprise a skin penetrating abutment which at one end is fastened to the screw and at the other end comprise coupling means which are designed for releasable coupling with a corresponding coupling means at the end of the rod. The coupling needs to balance the demand for a strong coupling between abutment and rod with the demand for a not to big brake away force, and usually a snap on mechanism is used whereby the hearing aid is pressed onto the abutment to cause engagement between the rod and the abutment. When a bone conducting hearing aid of this kind is pressed on to the skin penetrating abutment, the conventional arrangement results in a force on the vibrator inside the hearing aid housing and the vibrator may be damaged thereby. It is the aim of the invention to provide a connection between a bone conduction hearing aid and an abutment, which forms part of a bone integrated element to allow the hearing aid to be connected to the abutment without stressing the hearing aid vibrator. With such a connection, the wear on the vibrator will be reduced.

SUMMARY OF THE INVENTION

The hearing aid according to the invention comprises:

- a skin penetrating abutment,
- a rod with a coupling part, operative to allow releasable connection between the rod and the abutment,
- a hearing aid housing with an opening, where the rod extends through the opening and into the hearing aid housing,
- a vibrator connected to the rod in the hearing aid housing, where the vibrator is resiliently mounted between a distal housing wall part which faces away from the opening and a proximal housing wall part which comprises the opening, whereby the proximal wall part further comprise a relief portion which extends into the area between the vibrator and the coupling part of the rod, and where the distance between the relief portion and the coupling part of the rod is smaller than the distance between the vibrator and the inside of the distal wall part When the hearing aid according to the invention is to be coupled to the abutment, the coupling part of the rod is placed on the abutment, pressure is applied to the distal wall part by the user, and due to the resilient mounting of the vibrator in the housing, the housing will move towards the abutment whereby the relief portion of the proximal wall part will be forced against the coupling part of the rod whereby the coupling between the abutment and the coupling part of the rod is established. This is done without contact between the distal wall part and the vibrator. In this way the vibrator remains un-loaded during mounting of the hearing aid onto the abutment.

In an embodiment of the invention the relief portion is obtained by ensuring that the coupling has a diameter which is larger than the diameter of the hole in the hearing aid housing for the rod. With this diameter relationship a simple way of realizing the required relief portion in the hearing aid housing wall is easily established.

In a further embodiment of the invention the relief portion comprises a flange element provided at the rod in the area between the coupling part and the outside of the proximal wall part. Such a flange element allows the coupling part to be made with any shape, as there now is no connection between the dimensions of the coupling part and the diameter of the hole in the proximal wall part. This could be an advantage from an aesthetic point of view as it allows the apparatus to be made smaller.

In a further embodiment according to the invention, the proximal wall part around the opening is provided coplanar with the remaining proximal wall part. This allows the casing to be made with a flat side facing towards the hearing aid users head, and thereby a less protruding hearing aid can be made.

In yet a further embodiment, the proximal wall part around the opening is provided in a plane parallel to the plane of the raining proximal wall part, but off set from this plane. Off-setting the wall part around the opening or the rim of the opening towards the head of the user, allows further space for incorporation of an efficient dust gasket between the rod and the opening in the proximal wall part.

In a further embodiment of the invention, a push button is provided on an external surface of the housing and arranged to be pushed in a direction co-axially with the axis of the rod and connection part. A push button arranged as here specified, may be pushed in a direction towards the head of the user without the hearing aid being tilted by the force, as the force is applied in the axial direction of the connection with the implanted screw in the skull bone. This allows the button to be pushed with only one finger, and less dexterity is needed to use such a button. Further, as a result of the release portion the pressure applied on the button will not cause any stress on the vibrator even if excessive force should be applied to the push button. Preferably the push button is arranged to deliver an electrical input signal to the control electronics of the hearing aid when pushed, thus allowing the user to communicate with the hearing aid and control settings, such as choice of program or the like.

In a further embodiment the push button is a foil button. Foil switches or foil buttons comprise two layers of sheet material which are kept apart from each other by spring means, and which may be forced together by applying a force thereto from the outside. Usually the two sheet layers have electric connections on their facing sides which cause a short-cut between two poles of a contact to take place, when the foils or sheet material layers are pressed together. Such buttons or electric switches are well known in the art of communication devises. The use of foil switches allows a very flat push button to be made and this ad to the in-conspicuousness of the hearing aid.

In a further embodiment the push button is provided in a recess in the external surface part, whereby a ridge will be provided, which surrounds the push button. Having a ridge provided around the push button allows the user to locate the push button even if it is out of sight.

In a further embodiment the push button has a raised central part whereto pressure is to be applied in order to work the button. This raised central part allows the user to effectively identify the spot whereto pressure is to be applied when the push button is to be pressed to invoke a program shift or the like.

DESCRIPTION OF A PREFERRED EMBODIMENT

Figure 1:
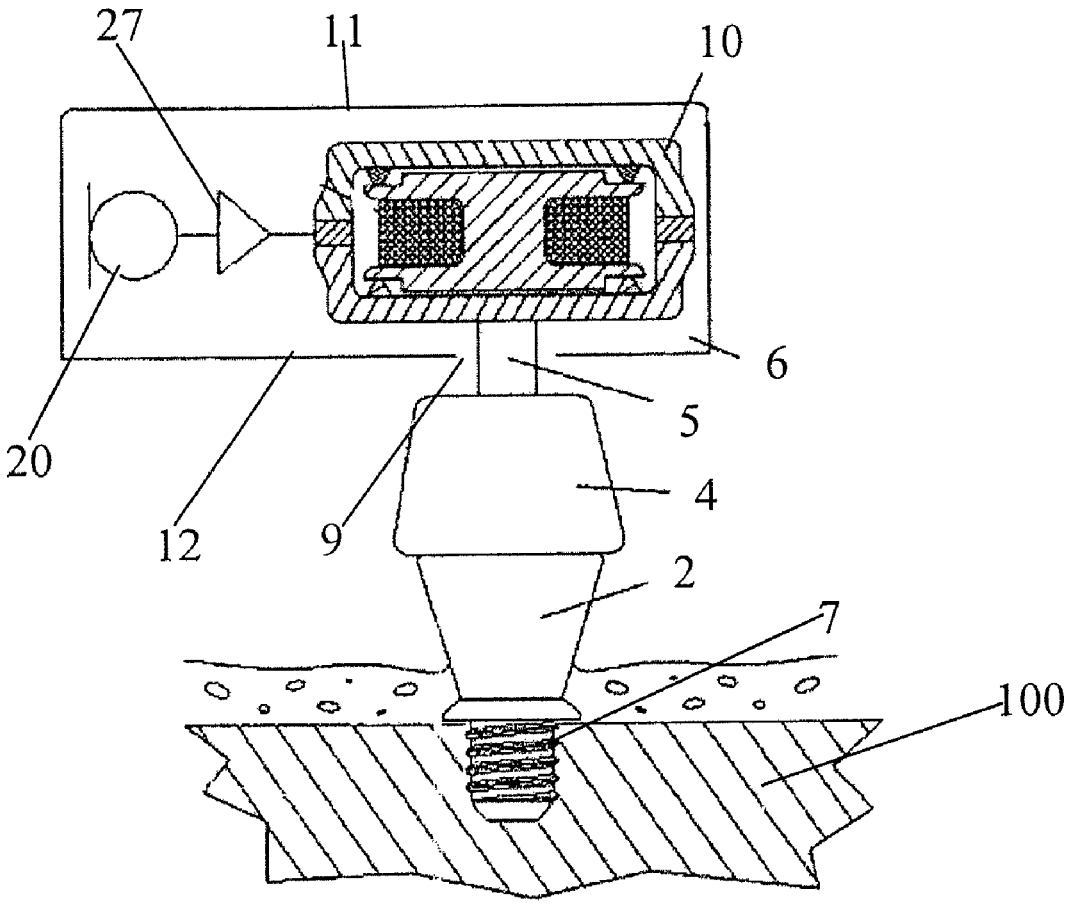
Fig. 1 Prior Art
FIG. 1 shows a section through a prior at hearing aid.

The prior art hearing aid shown in FIG. 1 comprises a skin penetrating abutment 2, a rod 5 with a coupling part 4, operative to allow releasable connection between the rod 5 and the abutment 2, where the rod 5 opposite the coupling part 4 extends into a hearing aid housing 6 through an opening 9 therein. A vibrator 10 resiliently mounted in the hearing aid housing 6 between a distal housing wall part 11 which faces away from the opening and a proximal housing wall 12 part which comprises the opening 9. When pressure is applied to the distal wall part 11 in order for the connection part 4 to get attached to the abutment 2, the wall parts 11 and 12 will move in unison until the inside of distal wall part 11, above the vibrator 10, collides with vibrator 10. This movement is due to the compliance of a connection between the vibrator 10 and the walls of the housing 6, and this compliance is required in order to avoid that vibrations from the vibrator 10 enters the microphone 20.

Also seen in FIG. 1, a screw 7 is mounted and integrated into the skull bone 100 of the hearing aid wearer.

Figure 2:
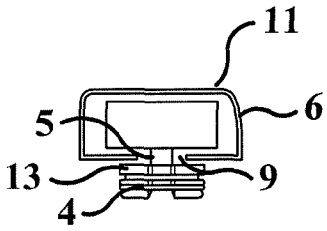
FIG. 2 displays a section through a schematic representation of a hearing aid according to the invention FIG. 3 displays a section trough a schematic representation of a hearing aid attached to the skull of a hearing aid user, FIG. 4 displays a further embodiment of a hearing aid according to the invention.
Figure 3:
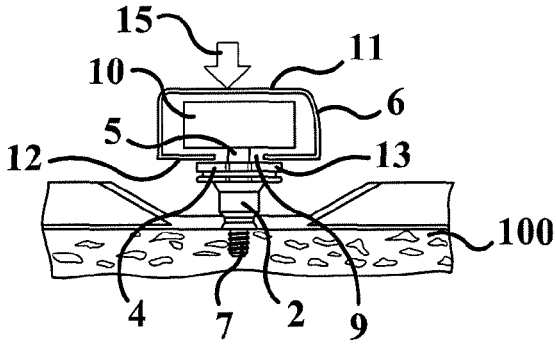

In FIGS. 2 and 3 schematic drawings of a hearing aid according to the invention are shown. Identical items are assigned identical reference numbers throughout the following description. The hearing aid in FIG. 3 is shown in a position under the influence of a downward force illustrated by arrow 15, whereas the hearing aid in FIG. 2 is shown in an un-affected state. Here the connection part 4 comprise a relief portion 13 where further the distance between the relief portion 13 and the under side of wall part 12 around the hole 9 is smaller than the distance between the vibrator 10 and the inside of the distal wall part 11.

When a force in the direction of the arrow 15 is applied to the distal wall part 11, the compliant suspension (seen in FIG. 5) between the hearing aid casing 6 and the vibrator 10 will give way, and the housing 6 will move in the direction of the arrow 15 until the area around the opening 9 in the proximal wall part 12 hits the relief portion 13 of the connection part 4. Further pressing down in the direction of the arrow 15 will cause the connection part 4 to be pressed into snap engagement with the abutment 2. In order to function as described the connection part 4 must have an upper flange portion, which at least in places has a diameter which is bigger than the diameter of the hole 9 in the wall part 12.

Figure 4:
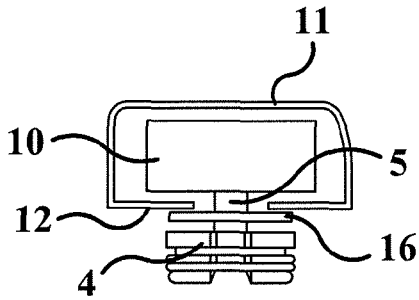

In an embodiment of the invention shown in FIG. 4 the rod has a flange part 16 extending radially away from the rod 5 above the connection part 4. This flange 16 will work in much the same way as the upper side of the connection part 4 as a relief portion, which ensures that there is no stress on the vibrator 10, once the hearing aid is pressed onto an abutment 4, as seen in FIG. 1.

In order to function as described above, the diameter of the hole 9 in wall part 12 need to be smaller than the diameter of relief portion 13 or flange portion 16. However, in to embodiments wherein at least one of the relief portion 13 or flange 16 or the hole 9 in wall part 12 are not circular, the design condition to be met is that at least in places, the rim of wall part 12 around the hole 9 is closer to the rod 5 than the outer reach of the relief portion 13 or flange 16.

In the new hearing aid arrangement, the distance between the coupling part 4 of the rod and the underside of the proximal wall 12 of the housing is smaller than the distance between the underside of the distal wall 11 and the vibrator 10. This distance relationship, along with the relief portion 13 or flange 16, accounts for the lesser strain on the vibrator 10 when the hearing aid is fastened to the abutment 2.

When the hearing aid is pressed on to the skin penetrating abutment 2, the conventional arrangement requires the apparatus to be pressed against the abutment 2, and this result in a force on the vibrator 10 which may be damaged. When the hearing aid according to the invention is pressed on to the skin penetrating abutment 2, the arrangement will however result in a force on the proximal side of the housing instead. Therefore the vibrator will last much longer with the new arrangement.

Figure 5:
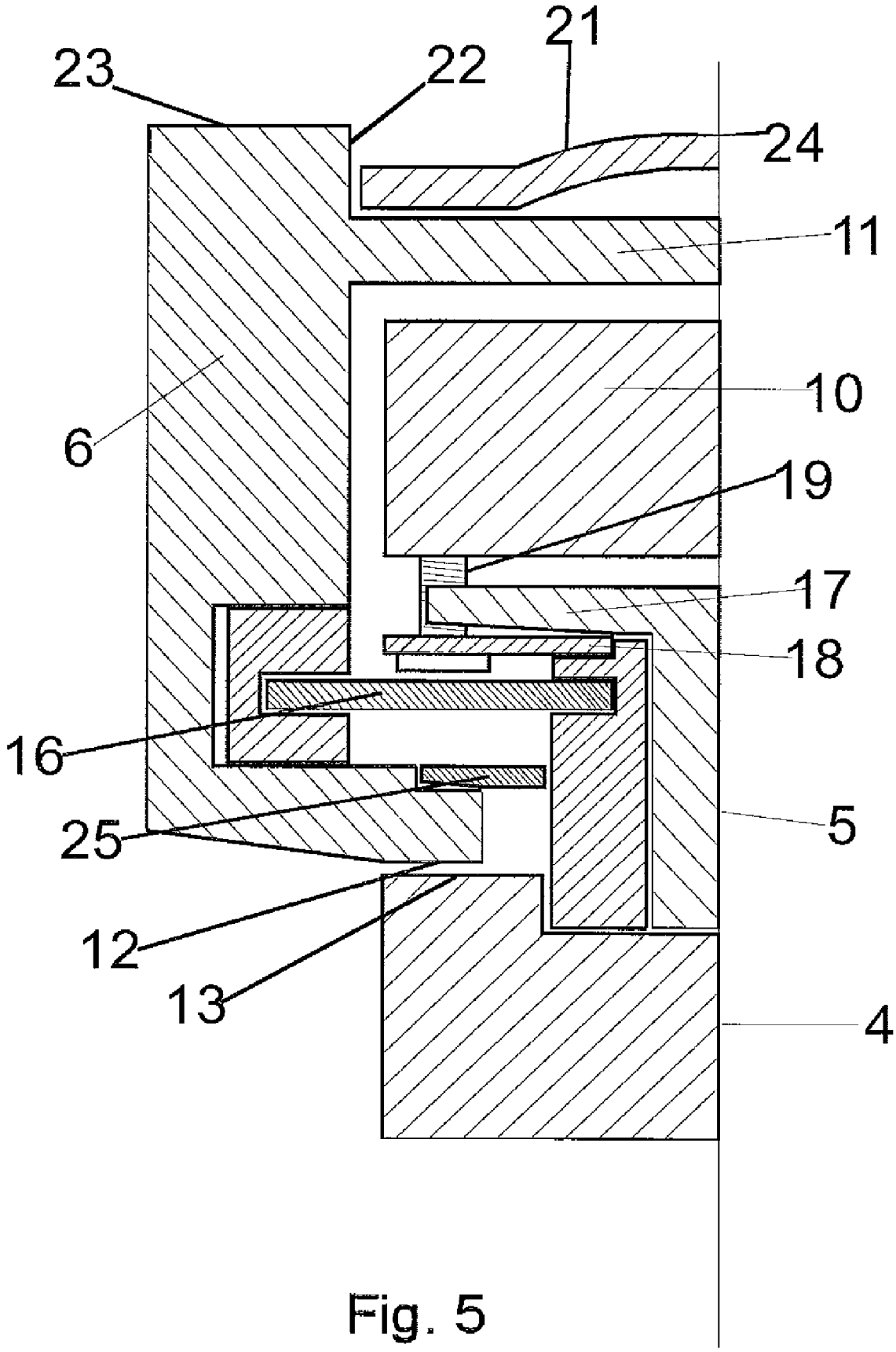
FIG. 5 is an enlarged section through a preferred embodiment of the hearing aid according to the invention.

FIG. 5 is a schematic representation of a cross section of a hearing aid according to the invention. As this part of the hearing aid is symmetrical, only half of the instrument is shown in the figure. The soft and compliant spring 16 which holds the vibrator 10 in place in the hosing 6 is seen. Due to the soft nature of his spring 16, the vibrator 10 will move when pressure is applied to the distal wall 11 of the housing 6. This pressure is necessary in order to attach the rod 5 to an abutment 2 via the connection part 4. As seen the rod 5 is made in unison with a vibrator plate 17 and further a vibrator spring 18 allows the plate 17 and rod 5 to move with respect to the vibrator 10 in response to electro-magnetic forces generated in the vibrator 10 as a result of an electric signal supplied to the vibrator 10. Due to the soft nature of the spring 16, the vibrations transmitted to the plate 17 and rod 5 will not be transmitted into the housing 6, but be transmitted through the connection part 4, the abutment 2 and the screw 7 and into the skull bone 100 of the healing aid user. As further seen in FIG. 5 the vibrator spring 18 is connected to the vibrator by suitable screws 19.

At the outside wall part of distal wall 11, a push button 21 is provided inside a recess 22 provided in the wall 11. The push button 21 allows the user to communicate with the hearing aid 1 whenever necessary. The recess 22 in the wall 11 in effect provides a raised ridge portion 23, which surrounds the push button 21. This ridge 23 aids the user in finding the right spot for applying pressure to the push button 21, which is out of view when used. Also the push button 21 comprise a raised central portion 24, where the pressure must be applied to make the button work, and this raised portion 24 along with the ridge portion 23 aids the user, who must navigate by means of tactile sense in the fingertip to find the right spot to press down, in order to use the push button 21. When the button 21 is pushed in the direction of the head, the line of force will be in the axial direction of the vibrator 10, the rod 5 and connector element 4, the abutment 2 and the screw 7. As explained earlier the spring 16 will give way to the force applied to push button 21 and the relief portion 13 of the connection element 4 will abut against the rim of the hole 9 in proximal wall part 12. In this way the user is allowed to press rather hard onto the push button 21 without harming the vibrator 10 inside the casing 6. Further, when pressure is provided to push button 21 in the direction of the head and in alignment with the axis of screw 7, no sideway moment is applied to the vibrator and this will aid to minimize the wear on vibrator 10 and ensure long life of this part. This effect is caused by the combined effect of the axial alignment of the parts comprising the push button 21, the vibrator 10, the rod 5, the connection part 4, and the abutment 2 and screw 7 and the distance requirements earlier mention between the relief portion 13, 16 and proximal wall part 12 and between the top of the vibrator 10 and the distal wall part 11.

A resilient dust gasket 25 is provided between the rim of hole 9 and the connection rod 5 in order that detrimental dirt particles such as dust will not enter the housing 6 and harm the delicate electro-mechanical parts of vibrator 10.

Figure 6:
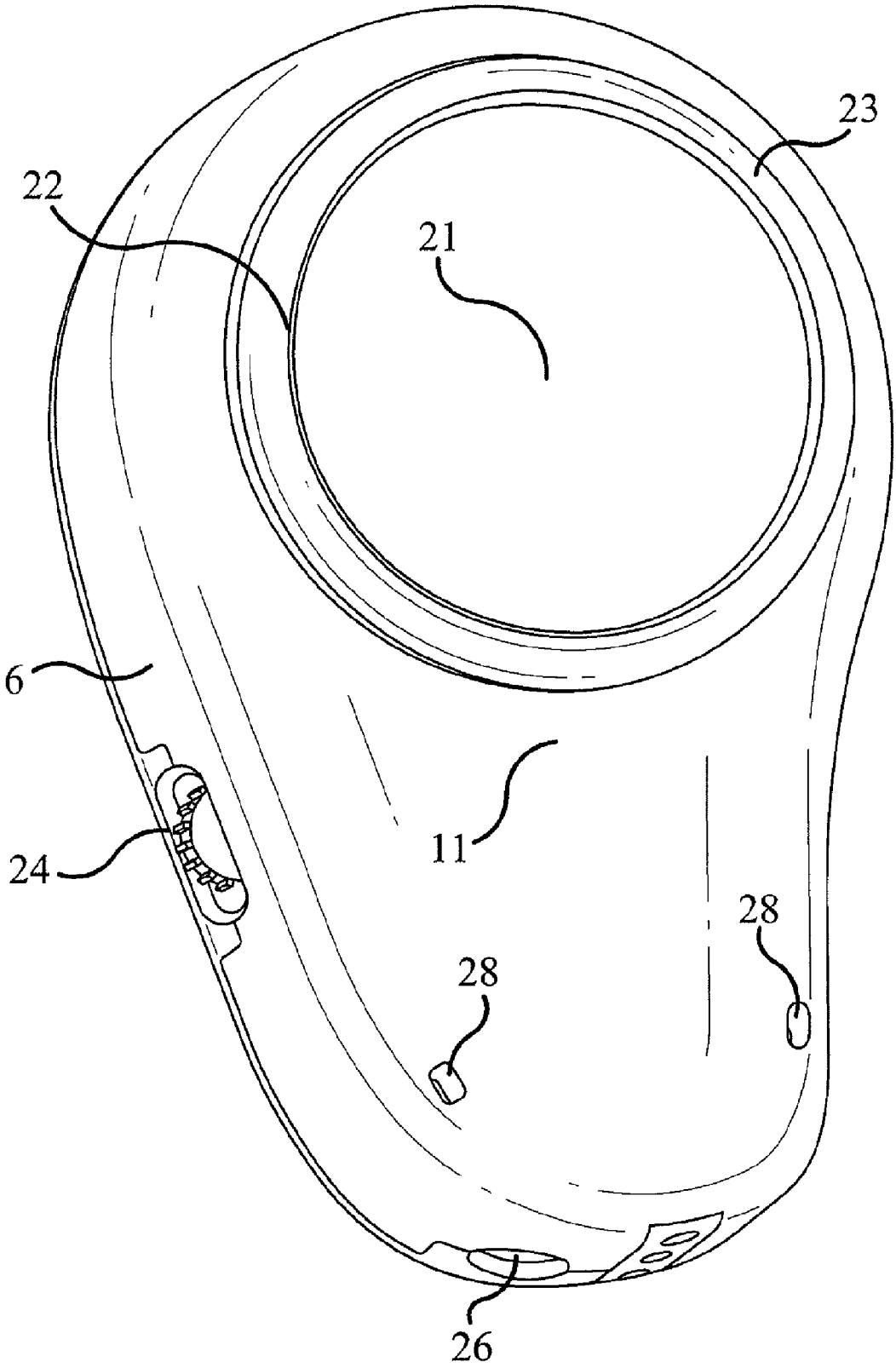
FIG. 6 shows a computer generated picture of a hearing aid according to the invention seen from above.

In FIG. 6 a computer generated picture of the hearing aid is shown partially from the distal wall part 11. In this figure the button 21 inside the perimeter of a recess 22 is clearly visible. Also visible in this figure are two microphone ports 28 provided in order that sounds in the environment may reach microphones (not seen in FIG. 6) inside housing 6.

Also a control wheel 24 is shown, which allows the user to provide further control input to the hearing aid. When the wheel 24 is used the apparatus may be gently supported between two fingers of the users hand such that the turning of the wheel 24 will not interfere with the workings of the vibrator 10 and transmission of vibrations to the skull bone 100.

The apparatus also comprises a socket allowing a programming device to be plugged into to the apparatus in order that the amplification strategy may be tuned to the needs and desires of the user. Also visible is socket for a jack for direct audio input also known as a DAI input 26. The two sockets, the microphone and the wheel are placed at one end of the hearing aid opposite the vibrator.

Figure 7:
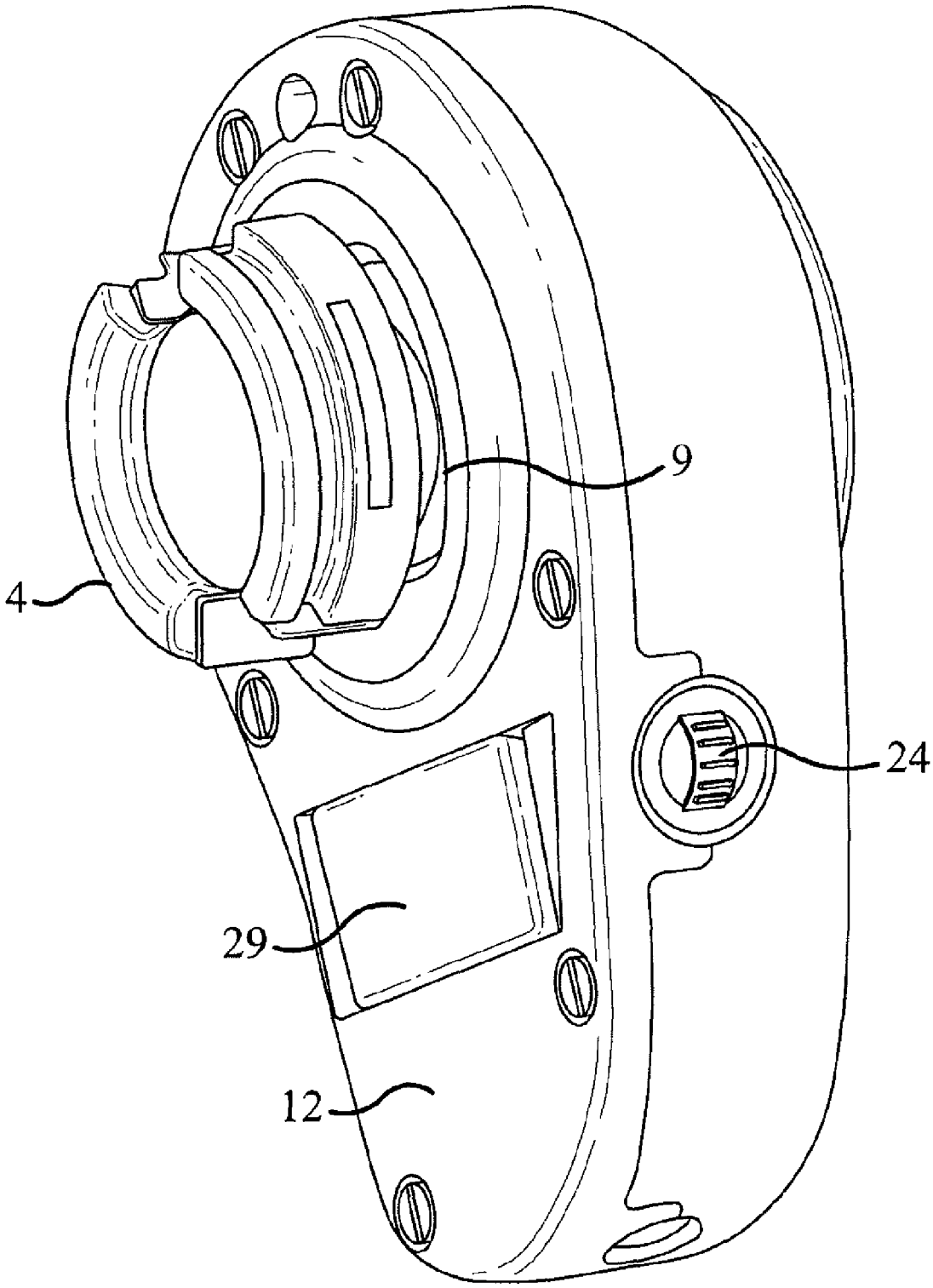
FIG. 7 shows a computer generated picture of a hearing aid according to the invention where the side turned towards the head of the user is visible.

In FIG. 7 the hearing aid is seen partially from below such that the proximal wall part 12 is visible along with connector part 4 and the hole 9. In this picture also a battery drawer 29 is visible. A circuit board inside the hearing aid will ensure connection between the mentioned elements: the battery for power supply, the microphones, the push button, the wheel, the external connection points or sockets, and the vibrator. When placed on the head of the user and properly programmed the sounds in the environments will enter through the microphone ports 28 and be converted to an electrical signal. The electrical signal will be processed in a signal processor 27 and served at the vibrator 10. In the vibrator 10, the signal is transformed into mechanical vibrations which through the skull bone, as explained above will reach the inner ear of the user and will be perceived as sound.

The invention claimed is:

1. Hearing aid comprising:

a skin penetrating abutment, a rod with a coupling part, operative to allow releasable connection between the rod and the abutment, a hearing aid housing with an opening, where the rod extends through the opening and into the hearing aid housing, a vibrator connected to the rod in the hearing aid housing, and resiliently mounted between a distal housing wall part which faces away from the opening and a proximal housing wall part which comprises the opening, whereby a relief portion is provided between the coupling part and the housing where the distance between the relief portion and the outside of the proximal wall part is smaller than the distance between the vibrator and the inside of the distal wall part.

2. Hearing aid according to claim 1, wherein the relief portion is obtained by ensuring that the coupling part has a diameter which is larger than the diameter of the hole for the rod in the hearing aid housing whereby the coupling part will comprise the relief portion.

3. Hearing aid according to claim 1, wherein the relief portion comprises a flange element provided at the rod in the area between the coupling part and the outside of the proximal wall part.

4. Hearing aid according to claim 1, wherein the proximal wall part around the opening is provided coplanar with the remaining proximal wall part.

5. Hearing aid according to claim 1, wherein the proximal wall part around the opening is provided in a plane parallel to the plane of the raining proximal wall part, but off set from this plane.

6. Hearing aid as claimed in any of the above claims wherein a push button is provided on an external surface of the housing and arranged to be pushed in a direction co-axially with the axis of the rod and connection part.

7. Hearing aid as claimed in claim 6 wherein the push button is a foil button.

8. Hearing aid as claimed in claim 6 wherein the push button is provided in a recess in the external surface part, whereby a ridge will be provided, which surrounds the push button.

9. Hearing aid as claimed in claim 6 wherein the push button has a raised central part whereto pressure is to be applied in order to work the button.

* * * * *